US008608267B2

(12) United States Patent
Therrien et al.

(10) Patent No.: US 8,608,267 B2
(45) Date of Patent: Dec. 17, 2013

(54) INK JETTING

(75) Inventors: Roger Therrien, Hanover, MA (US); Samuel Darby, North Andover, MA (US)

(73) Assignee: FUJIFILM Dimatix, Inc., Lebanon, NH (US)

( * ) Notice: Subject to any disclaimer, the term of this patent is extended or adjusted under 35 U.S.C. 154(b) by 729 days.

(21) Appl. No.: 12/481,715

(22) Filed: Jun. 10, 2009

(65) Prior Publication Data

US 2009/0322815 A1 Dec. 31, 2009

Related U.S. Application Data

(60) Provisional application No. 61/076,789, filed on Jun. 30, 2008.

(51) Int. Cl.
*B41J 29/38* (2006.01)

(52) U.S. Cl.
USPC ..... 347/14; 347/19

(58) Field of Classification Search
USPC ..... 347/14, 19
See application file for complete search history.

(56) References Cited

U.S. PATENT DOCUMENTS

| | | | | |
|---|---|---|---|---|
| 4,499,479 | A | 2/1985 | Lee et al. | |
| 5,265,315 | A | 11/1993 | Hoisington et al. | |
| 6,102,512 | A | 8/2000 | Torii et al. | |
| 6,378,972 | B1 | 4/2002 | Akiyama et al. | |
| 6,575,564 | B1 * | 6/2003 | Tsuchiya et al. | 347/70 |
| 6,755,511 | B1 | 6/2004 | Moynihan et al. | |
| 2002/0097290 | A1 * | 7/2002 | Koitabashi et al. | 347/16 |
| 2003/0122889 | A1 * | 7/2003 | Okuda | 347/19 |
| 2004/0066425 | A1 * | 4/2004 | Togashi et al. | 347/9 |
| 2005/0195244 | A1 * | 9/2005 | Inoue | 347/55 |
| 2009/0290000 | A1 | 11/2009 | McDonald | |

FOREIGN PATENT DOCUMENTS

| | | |
|---|---|---|
| JP | 7-323550 | 12/1995 |
| JP | 9-001796 | 1/1997 |
| JP | 2003-291334 | 10/2003 |
| JP | 2006-239861 | 9/2006 |
| WO | WO98/08687 | 3/1998 |

OTHER PUBLICATIONS

International Search Report and Written Opinion for App. Ser. No. PCT/US2009/046819, dated Nov. 27, 2009, 10 pages.
International Preliminary Report on Patentability for corresponding PCT Application No. PCT/US2009/046819, dated Jan. 13, 2011, 5 pages.
Office Action in Japanese Application No. 2011-516414, dated Nov. 29, 2012, 7 pages with English Abstract.
Office Action in Chinese Application No. 200980132928.2, dated Feb. 20, 2013, 9 pages with English translation.

* cited by examiner

*Primary Examiner* — Laura Martin
(74) *Attorney, Agent, or Firm* — Fish & Richardson P.C.

(57) ABSTRACT

Among other things, for use in ink jetting, a method includes reducing an anticipated variation in a characteristic of ink drops being jetted from an ink jet assembly, the reducing comprising causing a voltage that is applied on a jetting assembly to respond to the anticipated variation.

26 Claims, 5 Drawing Sheets

80

| Jetting Frequency (KHz) | Pulse Drive Volts (magnitude) | Pulse Width (usec) | Pulse Time (usec) | Fall Time (usec) |
|---|---|---|---|---|
| 1 | 80 | 10 | 2 | 2 |
| 2 | 80 | 10 | 2 | 2 |
| 3 | 80 | 10 | 2 | 2 |
| ... | | | | |
| 8 | 80 | 10 | 2 | 2 |
| 9 | 90 | 11 | 2 | 2 |
| 10 | 80 | 10 | 2 | 2 |
| ... | | | | |
| 12 | 70 | 9 | 2 | 2 |
| 13 | 80 | 10 | 2 | 2 |
| ... | | | | |
| 24 | 65 | 8 | 2 | 2 |
| 25 | 62 | 8 | 2 | 2 |

FIG. 3C

INK JETTING

This application claims the benefit of U.S. Provisional Application No. 61/076,789, filed Jun. 30, 2008, and incorporated herein by reference.

TECHNICAL FIELD

This description relates to ink jetting.

BACKGROUND

Ink jetting can be done using an ink jetting printhead that includes jetting assemblies. Ink is introduced into the ink jetting printhead and when activated, the jetting assemblies jet ink and form images on a substrate.

SUMMARY

In one aspect, for use in ink jetting, a method includes reducing an anticipated variation in a characteristic of ink drops being jetted from an ink jet assembly, the reducing comprising causing a voltage that is applied on a jetting assembly to respond to the anticipated variation.

In another aspect, for use in ink jet printing, a method comprising determining a quantitative relationship between a jetting frequency of a jetting assembly and a characteristic of ink drops jetted from the jetting assembly; and providing the determined quantitative relationship for use in varying the characteristic of the ink drop.

In another aspect, an ink jet printing system includes a jetting assembly and a unit for determining an anticipated variation in a characteristic of ink drops jetted from the jetting assembly and applying a voltage to the jetting assembly based on the anticipated variation.

Implementations may include one or more of the following features. The characteristic of ink drops comprises the mass of the ink drops. The characteristic of ink drops comprises the speed of the ink drops. The characteristic of ink drops is anticipated based on a frequency of jetting of the ink drops. The frequency is determined based on transport speed of a substrate on which the ink drops are jetted. The characteristic of the ink drops jetted at the frequency is determined using a pre-determined quantitative relationship between the frequency and the characteristic. The anticipated variation of the characteristic is determined by comparing the characteristic to a standard. The voltage applied on the jetting assembly is in the form of pulses. Causing the voltage to respond to the variation comprises varying an amplitude of the pulses. Causing the voltage to respond to the variation comprises varying a width of the pulses. The pulses have a form that comprises at least square, triangle, and trapezoidal. The voltage is generated based on the anticipated variation. The generated voltage is amplified and applied to the jetting assembly. The voltage applied on the jetting assembly ranges between about 70 V to about 150 V. The ink drops have a size of about 1 pico-liter to about 80 pico-liter. The ink drops have a speed of about 1 m/s to about 12 m/s. The frequency ranges from about 1 KHz to about 25 KHz.

Implementations may also include one or more of the following features. The quantitative relationship is non-linear. The characteristic of the ink drops is varied by varying a voltage applied to the jetting assembly.

Implementations may also include one or more of the following features. The ink jet printing system also includes an encoder to determine a transport speed of a substrate on which the ink drops are jetted and a microprocessor to calculate a frequency of the jetting assembly based on the transport speed. The unit comprises a controller for receiving the frequency. The controller is connected to a microprocessor for determining the anticipated variation in the characteristic and the voltage to reduce the anticipated variation. The microprocessor determines a pulse magnitude of the voltage. The microprocessor determines a pulse width of the voltage. The microprocessor includes a medium that stores a pre-determined relationship between the frequency and the characteristic of the ink drops. The unit comprises a pulse generator for generating the voltage. The jetting assembly comprises 100 to 2000 jets. The ink jet printing system also includes an amplifier to amply the voltage applied on the jetting assembly. The ink jet printing system also includes additional jetting assemblies, each having a pre-determined relationship between a jetting frequency of the corresponding jetting assembly and characteristics of ink drops jetted from the jetting assembly.

All mentioned publications, patent applications, patents, and other references are incorporated by reference in their entirety.

Other features and advantages of the invention will be apparent from the following detailed description, and from the claims.

DESCRIPTION

FIG. 3C is a look-up table.

Figure 1B:
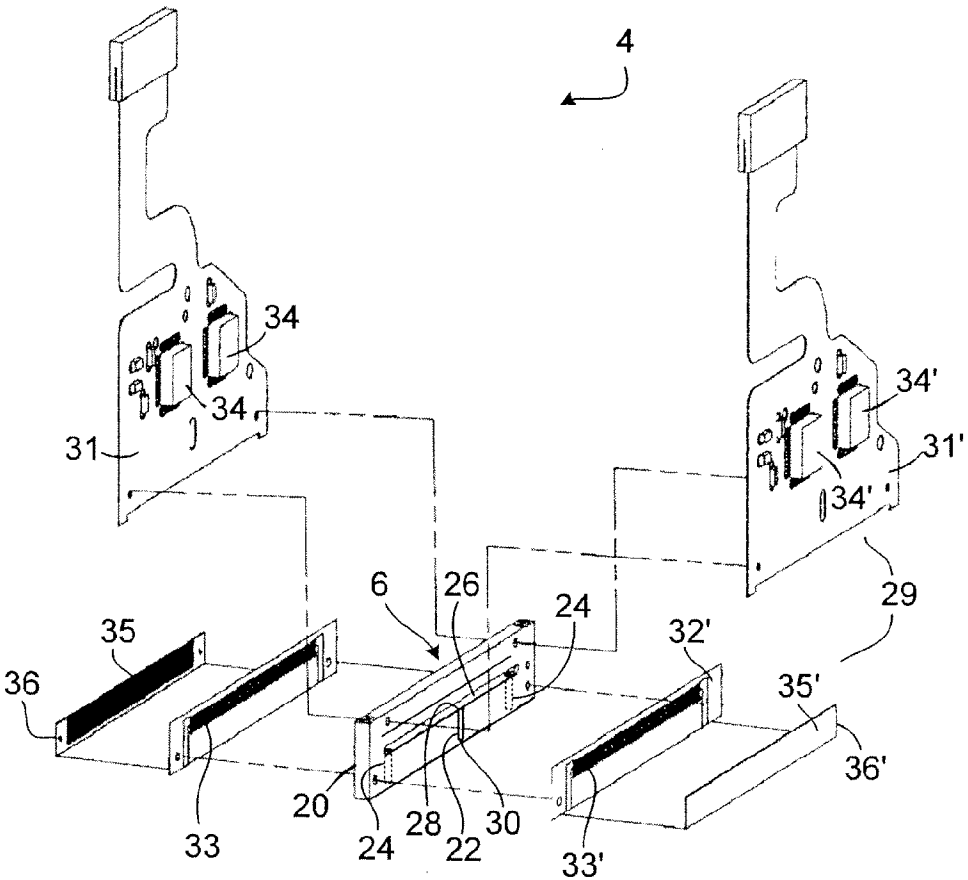
FIG. 1B is an exploded perspective view of a jetting assembly.
Figure 1A:
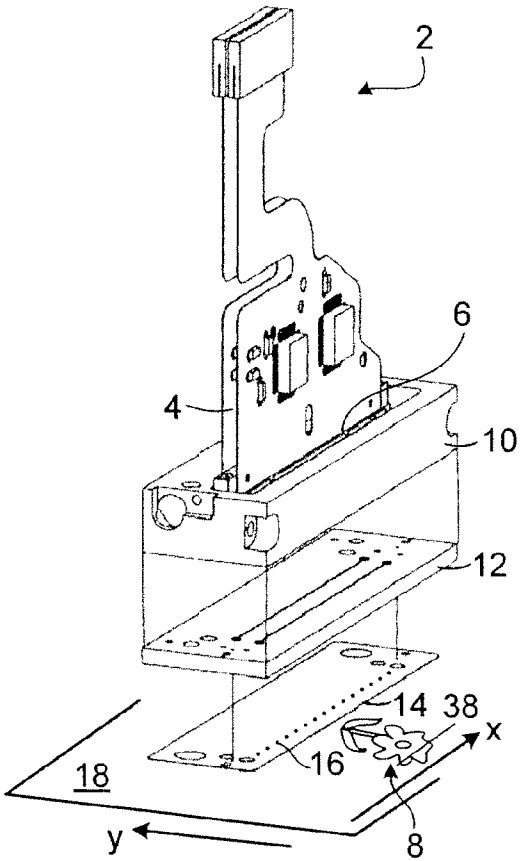
FIG. 1A is an exploded perspective view of an ink jet printhead.

Referring to FIG. 1A, ink jetting can be done using an ink jetting printhead 2 that includes at least one jetting assembly 4 assembled into a collar element 10. The collar element 10 is attached to a manifold plate 12 which is attached to a plate 14 having orifices 16. When in use, the printhead 2 and a substrate 18 move relative to each other along a process direction y perpendicular to a length 6 of the jetting assembly (see also FIG. 1B) and during the relative motion, ink is loaded into the jetting assembly 4 through the collar element 10 and jetted through orifices 16 to form images 8 on a substrate 18.

Referring to FIG. 1B, the ink jetting assembly 4 has a body 20 that includes one or more ink passages 24 and an ink fill passage 26. A cavity plate and a stiffener plate (not shown) are attached on the opposite surfaces of the body 20 to form an array of wells 22 (not all shown) on each surface. Each well 22 can be elongated and the body 20 can include ceramic, sintered carbon, or silicon. Each ink passage 24 receives ink from an ink reservoir (not shown) and delivers ink to the ink fill passage 26. When the opposite surfaces are covered by polymer films 32 and 32', elongated pumping chambers are formed by the wells 22, each including an ink inlet 28 to receive ink from the ink fill passage 26 and an ink outlet end 30 to direct ink back into the body 20 through an ink jetting passage (not shown) and be jetted at one of a row of openings (not shown) at the bottom of the body 20. In some embodiments, the orifice plate 14 (FIG. 1A) is attached directly to the bottom of the body 20. Each orifice 16 on the orifice plate 14 corresponds to one opening and ink is jetted through the orifices 16 onto the substrate 18 (FIG. 1A). In some embodiments, when two or more jetting assemblies 4 are assembled in the printhead 2 as shown in FIG. 1A, the manifold plate 12 is arranged between bottoms of the bodies 20 and the orifice plate 12 and manifolds multiple rows of openings, each at the bottom of one body 20, into a single row of openings from which ink passes.

Generally, each pumping chamber, together with its corresponding ink jetting passage, the opening and the orifice can be referred to as a jet of the jetting assembly. Information about the jetting assembly 4 is also provided in U.S. Ser. No. 12/125,648, filed May 22, 2008, which is incorporated here by reference.

The jetting assembly 4 also includes electronic components 29 to trigger the pumping chambers formed from the wells 22 to jet ink. For example, the electronic components include two sets of electrodes 33 and 33' on the polymer films 32 and 32', which are connected by leads (not shown) to respective flexible circuits 31, 31' and integrated circuits 34 and 34', to which the information about the image to be printed is loaded. Piezoelectric elements 36 and 36' are attached to the outer side of each of the polymer films 32 and 32', respectively and each includes a set of electrodes 35 and 35' that contacts the polymer films 32 and 32'.

The integrated circuits 34 and 34' each includes a set of switches, each switch corresponding to one of the pumping chambers in the body 20. Based on the loaded image data, in one jetting event, the switches corresponding to the pumping chambers that are required to jet ink are set to be on and the switches corresponding to the rest of the pumping chambers are set to be off. The integrated circuits 34 and 34' then forward voltage pulses to the electrodes 35 that address those pumping chambers corresponding to switches in the "on" state to activate the portion of piezoelectric elements 34 and 34' over these chambers.

Figure 1C:
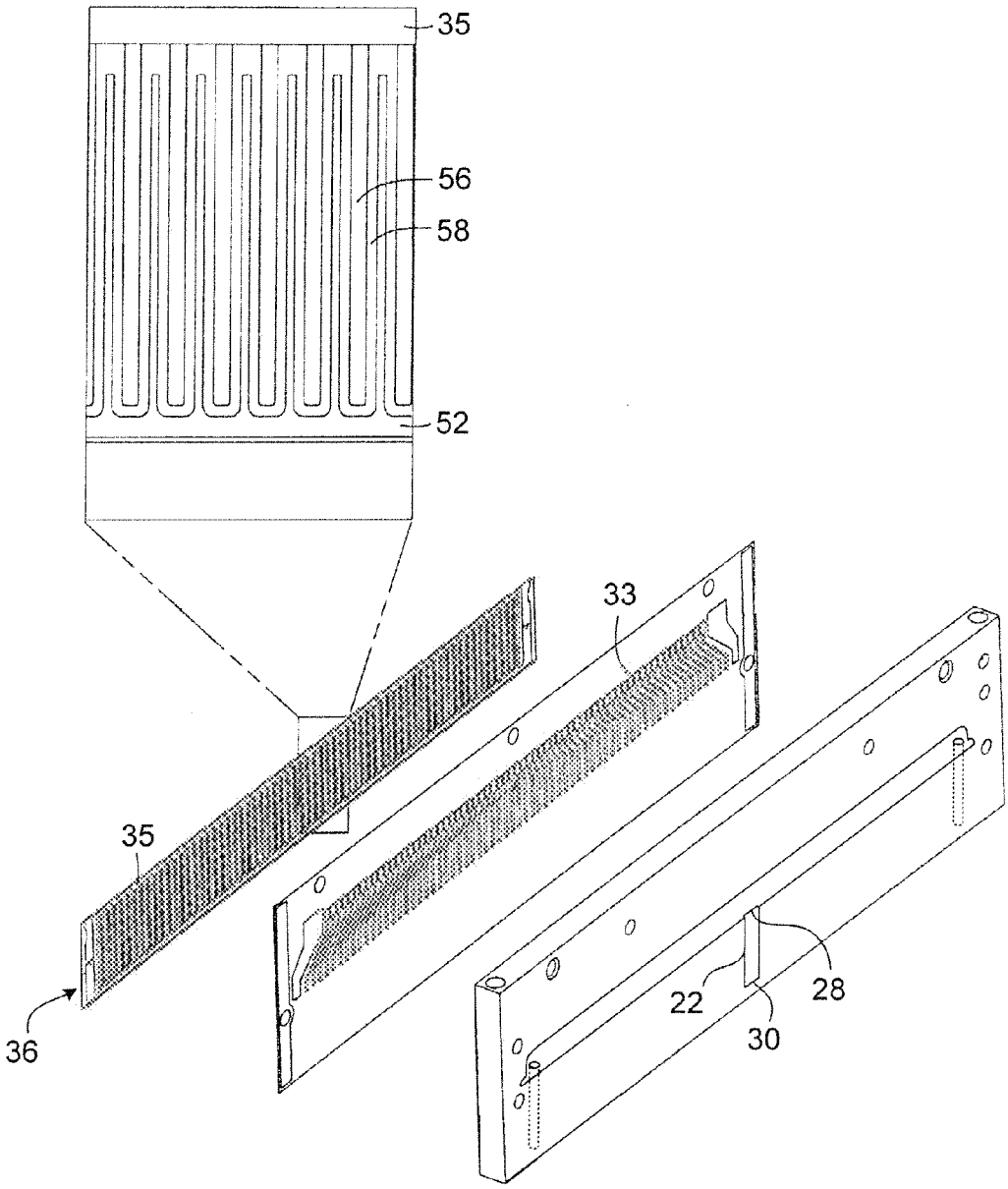
FIG. 1C is an exploded perspective view of a portion of a jetting assembly.

Referring to FIG. 1C, the electrodes 35 on the piezoelectric element 36 register with electrical contacts 33, allowing the electrodes to be individually addressed by the integrated circuit 34 as explained above. Each of the electrodes 35 is placed and sized to correspond to a pumping chamber in the body 20. In particular, each electrode 35 has an elongated region 56, having a length and width slightly narrower than the dimensions of each pumping chamber such that gap 58 exists between the perimeter of the electrodes 35 and the sides and end of each pumping chamber. Each electrode region 56 is centered on a pumping chamber and is the drive electrode that covers a jetting region of the piezoelectric element 36. A second electrode 52 on the piezoelectric element 34 generally corresponds to the area of the body 20 outside the pumping chambers. The electrode 52 is the common (ground) electrode and can be comb-shaped (as shown) or can be individually addressable electrode strips. The electrical contacts 33 and the electrodes 35 overlap sufficiently for good electrical contact and easy alignment of the electrical contacts 33 and the piezoelectric element 36. Information about the ink jet module 2 is also provided in U.S. Pat. No. 6,755,511, which is incorporated here by reference.

To print each line 38 of the two-dimensional image 8 on the substrate 18 (FIG. 1A), appropriate voltage pulses sent from the integrated circuits 34 and 34' cause the piezoelectric elements 36 and 36' to change their shapes and apply pressures to selected pumping chambers from which ink drops are to be jetted. Successive lines are printed as the substrate moves along the y direction. Thus, for a given number of lines per inch along the process direction y to be printed on the substrate 18, the frequency at which voltage pulses must be provided for a given pumping chamber is related to the transport speed of the substrate 18 along the process direction y. The resolution of a printed image along the y direction and the direction perpendicular to the y direction can be expressed by the number of dots per inch (dpi). In some embodiments, the jetting assembly 4 or the ink jet module 2 can print an image having a resolution of greater than 100 dpi, greater than 200 dpi, greater than 400 dpi, greater than 500 dpi, greater than 800 dpi, greater than 1000 dpi, or even larger along each direction.

The mass and velocity of the jetted ink drops vary with the frequency of jetting and therefore with the transport speed of the substrate.

Figure 2:
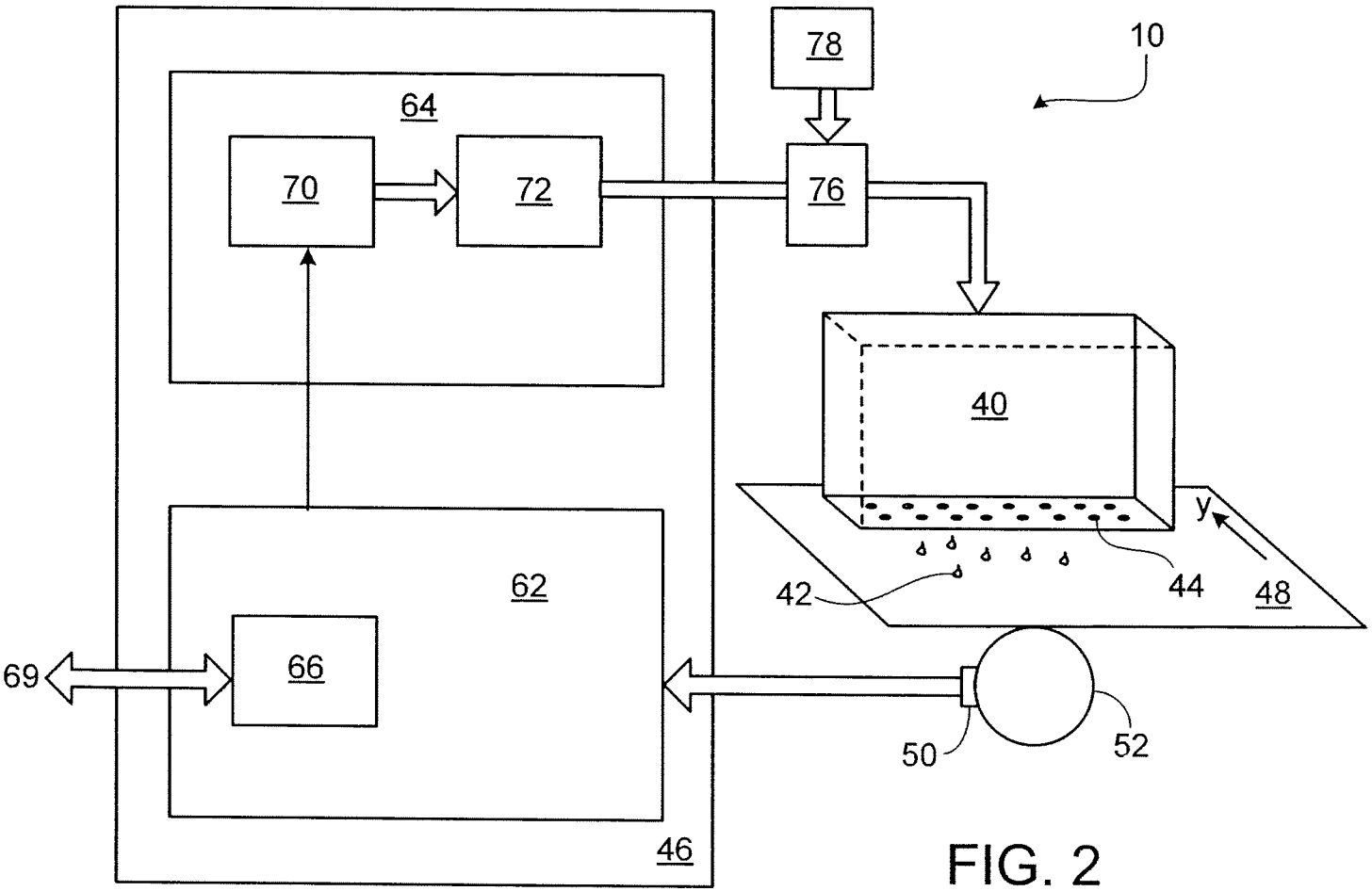
FIG. 2 is a block diagram of an ink jet printer.

In FIG. 2, the voltage pulses are provided to the piezoelectric elements of an ink jet printhead 40 having the same features as the ink jet printhead 4 of FIG. 1A from a pulse unit 46 to jet ink drops 42 out of orifices 44 onto a substrate 48. The pulse unit 46 also measures the current transport speed of the substrate 48 along the process direction y from signals received from an encoder 50 that is coupled to sense motion of the transport 52 on which the substrate 48 is carried along.

The encoder 50 can be a shaft angle encoder in communication with the transport 52 and can provide a stream of signals from which a transport speed of the substrate 48 can be determined. The transport speed of the substrate 48 is associated with a jetting frequency at which voltage pulses are delivered to the ink jet printhead 40 and ink is jetted from the pumping chambers. In some embodiments, the jetting frequency of the ink jet printhead 40 can be computationally determined using a microprocessor based on the transport speed. For example, the encoder 50 is located on a transport belt (not shown) that transports the substrate 18 and produces a stream of pulses related to the speed of the belt. For example, the higher the transport speed the higher number of pulses/sec and therefore the higher the frequency of change. A microprocessor (not shown) can be used to measure the time period between the rising edges of the stream of pulses and then determine the operational jetting frequency of the ink jet printhead 40 using the following formula Frequency (Hertz)=1/Period (sec).

Alternatively, a frequency to voltage converter can be used to generate an analog voltage, for example, between 1 to 10 volts, based on the transport speed. A digital representation of the transport speed and the jetting frequency are converted from the voltage by an analog to digital converter in communication with the frequency to voltage converter. For example, the frequency to voltage converter uses the repetitive pulses from the encoder 50 to charge a circuit to produce an analog voltage representative of the speed of the transport of the substrate 18.

The jetting assemblies performs ink jetting differently in response to different jetting frequencies, which vary accordingly with the variation in the transport speed of the substrate 18, and/or the variation in properties of the jetting assemblies, the properties of the ink used, for example, viscosity, and/or the operational temperature of the ink jetting. For example, the ink drops 42 out of the orifices 44 jetted at different jetting frequencies can have different characteristics, for example, mass or speed. To achieve high quality printing, it is desirable to have the jetting assemblies' performance uniform at different jetting frequencies.

To produce ink drops with uniform characteristics, it is therefore desirable to understand the relationship between the transport speeds of the substrate 48 or jetting frequency of the ink jet printhead 40 and the characteristic of the ink drops 42 and reduce the variations in the characteristic of the ink drops 42. The jetting frequency of the ink jet printhead 40 is the frequency at which the printhead 40 places an ink drop at every pixel. The individual jets in the printhead 40 can be operating at an operating frequency different from the jetting frequency of the printhead 40.

Figure 3A:
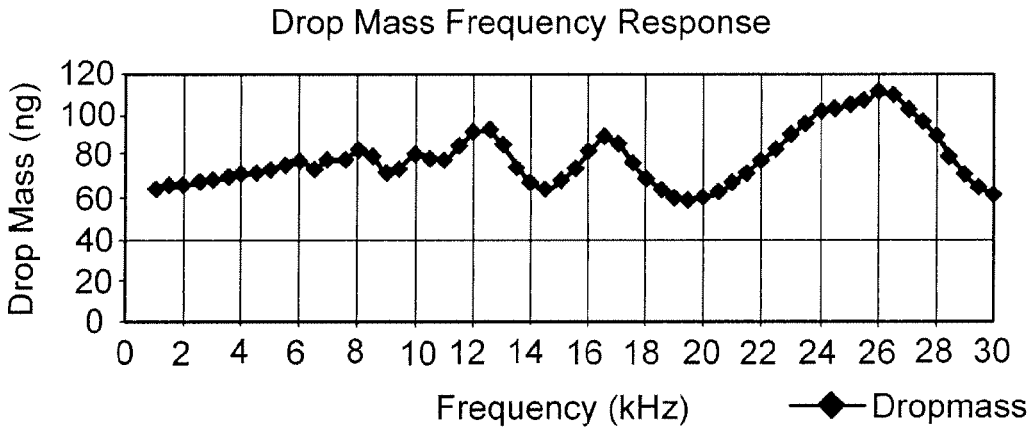
FIGS. 3A and 3B are graphs of ink drop mass versus jetting frequency and ink drop velocity versus jetting frequency.
Figure 3B:
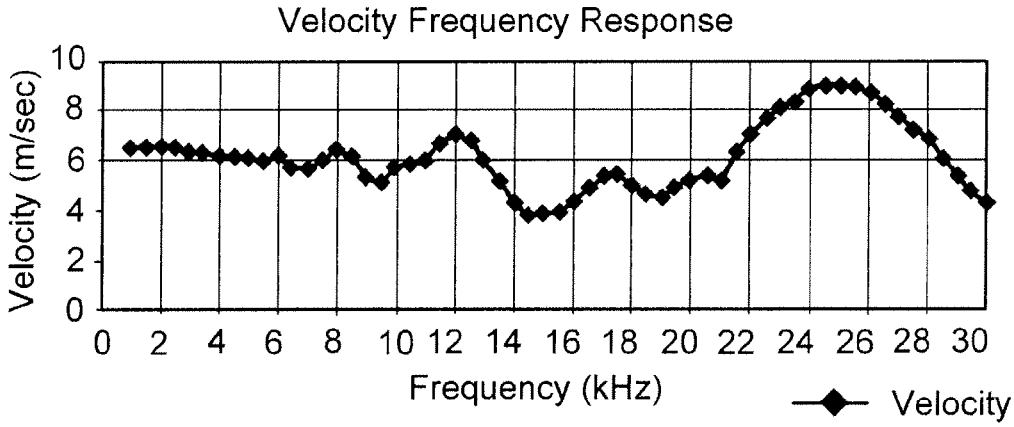

Referring to FIGS. 3A and 3B, the mass and velocity of ink drops vary irregularly from one jetting frequency to another frequency. For example, when the jetting frequency of the jetting assembly 12 is 14.5 KHz, the ink drops have a lower drop mass and a lower velocity, which could result in light printing or misaligned printing. Also, when the jetting frequency is increased to 25.5 KHz, the ink drop has a mass and a velocity about 100% higher than those of the ink drops jetted at the jetting frequency 14.5 KHz. Depending on the printing requirement and other related conditions, the ink drops can have a size of about 1 pico-liter to about 100 pico-liters, for example, 1 pico-liter to 80 pico-liters and a speed of about 1 m/s to about 20 m/s, for example, 1 m/s to 12 m/s.

The quantitative relationship between the jetting frequency of the printhead 40 and the mass of the ink drops and the quantitative relationship between the jetting frequency and the velocity at which the ink drops are jetted are both nonlinear and have a similar trend. To make the ink drop mass and velocity more uniform at all frequencies, the voltage pulses to be applied on the jetting assemblies can be adjusted based on these known quantitative relationships. For example, at a jetting frequency 14.5 KHz, a higher voltage pulse can be delivered to the ink jet printhead 40 to cause the piezoelectric element to generate higher pressures over the pumping chambers to compensate the anticipated low drop mass and drop velocity implied by the known relationships. By contrast, at a jetting frequency of 25.5 KHz, a lower voltage can be delivered to cause the piezoelectric element to provide proper pressures on the pumping chambers to reduce the anticipated high drop mass and drop velocity.

In some embodiments, ink jet printheads of the same type demonstrate similar trends in these quantitative relations, for example, when using the same type of ink. This allows use of these quantitative relationships in producing uniform ink drops with uniform velocities for high quality images on ink jet printers that include the same type of ink jet printheads in a systematic way. In practice, the quantitative relationships like the ones shown in FIGS. 3A and 3B are predetermined, for example established empirically, for one type of ink jet printhead and ink, and a standard for the desired mass and velocity of ink drops is chosen.

Based on the chosen standard and the determined quantitative relationships, at each jetting frequency, an anticipated variation of the ink drop mass and velocity with respect to the standard is calculated. To reduce the anticipated variation and make the ink drop characteristics conform uniformly to the standard, a compensating voltage additional to the original voltage pulse associated with that jetting frequency is calculated and added to the original voltage pulse to provide a compensated voltage pulse. In some embodiments, the compensating voltage has a negative magnitude and is deducted from the original voltage pulse to decrease the ink drop mass and velocity. In some embodiments, the compensating voltage has a positive magnitude and is added to the original voltage to increase the ink drop mass and velocity.

In some implementations, for each type of ink that is used, tests on the characteristics of the ink drops jetted from the printheads are conducted using various compensated voltage pulse parameters, e.g., amplitude, rise/fall time, and width, where a camera is used to visually see how the ink drops are jetted and formed. The parameters describing the compensated voltage pulses are empirically modified or chosen to provide the desired drop formation with consistent print quality across the jetting frequency range.

The jetting frequency obtained from the transport speed of the substrate 48 as described above is associated with all pumping chambers of the ink jet printhead 40 and can be different, for example, larger, than the operating frequency of an individual jet because at each moment, only a portion of the jets are jetting ink based on the requirement of the image to be printed. Therefore, the variations in the characteristics of ink drops from different individual jets at one jetting frequency of the ink jetting printhead 40 are different. For example, at the determined printhead jetting frequency 14.5 KHz, some of the jets are not jetting ink, some are jetting at a frequency of 7.25 KHz if they are printing every other pixel, or some others are jetting at a lower frequency if they are printing fewer than every other pixel. According to the quantitative relationships of FIGS. 3A and 3B, the mass and velocity of the ink drops jetted from these different jets at these different operating frequencies are different and needs different adjustments to the voltage pulses applied to the corresponding pumping chambers to make the ink drops uniform.

In some embodiments, the compensating voltage is applied to all jets that are printing at the moment when the printhead 40 has the corresponding jetting frequency. Even though only some of the jets are operating at the jetting frequency of the printhead 40, uniform application of the compensating voltage improves the image quality.

In some embodiments, to reduce the overall variations in ink drop characteristics that are jetted from different individual jets, the compensating voltage corresponding to the jetting frequency of the ink jet printhead 40 is further adjusted, for example, the magnitude of the voltage to be 90%, 80%, 70%, 60%, or 50% of the calculated or determined value.

Referring to FIG. 3C, a look-up table 80 recording the calculated or adjusted compensated voltage pulse associated with each jetting frequency of the printhead 40 is generated. In some embodiments, the look-up table 80 records information of the voltage pulses that includes, for example, magnitude, rise time, fall time, and/or width. In the example shown in the figure, the standard pulse voltage is chosen to have a magnitude of about 80 volts, a width of about 10 μseconds, a rise time of about 2 μseconds, and a fall time of about 2 μseconds. Using the determined quantitative relationship between the ink drop characteristics and the jetting frequencies of FIGS. 3A and 3B and the standard, at jetting frequency 9 KHz, where a low ink drop mass and velocity are anticipated, a 10 volt compensating voltage is estimated and the compensated voltage has a magnitude of about 90 volts and an prolonged pulse width of about 11 μseconds. When the jetting frequency is 24 KHz, where a high ink drop mass and velocity are anticipated, a −15 volt compensating voltage is estimated and the compensated voltage has a magnitude of about 65 volts and a shortened pulse width of about 8 μseconds.

In some embodiments, multiple printheads may be used to print an image and each printhead may have an associated look-up table.

Referring back to FIG. 2, the look up table is stored in the memory of a microprocessor 66 in a pulse control unit 62 of the pulse unit 46. In some embodiments, the microprocessor 66 has a communication interface 69. In some embodiments, the pulse control unit 62 uses programmed parameters of the desired voltage pulse waveform, for example, amplitude, pulse width, and rise and fall time, to create the desired shape and size of the pulse voltage waveform. In use, the pulse controller 62 receives signals representative of the transport speed of the substrate 48 generated by the encoder 50 and encodes the signals to a jetting frequency associated with the transport speed so that the pulse voltages are generated at the right time at appropriate dots/inch resolution.

The information of the jetting frequency is used by the microprocessor 66, to find the information of the voltage pulse corresponding to that jetting frequency in the stored look-up table.

A voltage pulse to be applied on the piezoelectric element of the printhead 40 is generated in the pulse generation unit 64 of the pulse unit 46, based on the information sent from the pulse control unit 62. The pulse generation unit 64 includes a pulse generator 70 and a pulse shaper 72. The pulse generator 70 includes a digital to analog (D/A) converter that generates a voltage pulse based on the information received from the pulse control unit 62. In some embodiments, the D/A converter generates a voltage pulse that has a magnitude, for example, of about 5 volts, 10 volts, or 15 volts, and/or up to, for example, about 30 volts, a rise time, for example, of about 1 μseconds, or 2 μseconds, and/or up to, for example, about 4 μseconds, or about 5 μseconds, a fall time, for example, of 1 μseconds, or 2 μseconds, and/or up to, for example, about 4 seconds, or about 5 μseconds, and a width, for example, of about 2 μseconds, 4 seconds, 5 μseconds, and/or up to, for example, about 15 μseconds, 20 μseconds, or about 25 μseconds.

Generally, the voltage pulses generated from the D/A converter have low magnitudes and need to be amplified proportionally before applying to the ink jet printhead 40, which will be discussed later. The pulses generated from the pulse generator 70 are filtered by a pulse shaper filter at the pulse shaper 72 to provide a desired waveform.

Examples of pulse shaper filter include, for example, trivial boxcar filter, sinc shaped filter, raised-cosine filter, and Gaussian filter. Examples of waveforms of the voltage pulses include, for example, sine waves, sawtooth waves, square waves, triangle waves, trapezoidal waves and their combinations.

The voltage pulse from the pulse shaper 72 is delivered to an amplifier 76. A high voltage supply 78 is connected to the amplifier 76 to provide a high voltage. The amplified voltage pulse can have a magnitude, for example, of at least about 30 V, 60 V, 65 V, or 70 V, and/or up to, for example, about 160 V, 155 V, or 150 V. The amplified voltage pulse is applied to the ink jet printhead 40 to cause ink to be jetted with desired drop mass and velocity onto the substrate 48.

The system response time of pulse unit 46 to changes in transport speed is in the order of milliseconds. This allows the ink pulse unit 46 to respond to the anticipated variation in the ink drop characteristics associated with a jetting frequency of the ink jet printer 40 and effectively reduce the anticipated variation to produce high quality images.

Other embodiments are in the following claims.

For example, printheads other than that described in FIG. 1A can be used, for example, printheads that are made of silicon and described in U.S. Pat. No. 5,265,315 and print heads described in U.S. Ser. No. 12/125,648, filed May 22, 2008, both of which are incorporated here by reference. For example, the jetting assembly 4 can include the body 20 having wells machined on surfaces of the body 20. Pumping chambers can be formed without the use of the cavity plate and by sealing the machined wells in the body 20 using polymer films. The pumping chambers can be activated by piezoelectric elements attached to an outer surface of the polymer films that is opposite to an inner surface that contacts the body 20. In some implementations, the piezoelectric elements can directly seal the wells to form pumping chambers without the polymer films between the wells and the piezoelectric elements. Activation of the pumping chambers can be done using elements, e.g., electrodes and integrate circuits, similar to those discussed with regard to FIGS. 1A-1C. Features of the ink droplets and images, for example, sizes of the ink droplets and resolution of the images, printed by such jetting assemblies are similar to those printed by the jetting assemblies of FIGS. 1A-1C.

What is claimed is:

1. A method for use in ink jetting, the method comprising:

determining a characteristic of ink drops being jetted from an ink jet assembly at a jetting frequency using a pre-determined quantitative relationship between the jetting frequency and the characteristic, reducing an anticipated variation in the characteristic of the ink drops, the reducing comprising causing a voltage that is applied on the ink jet assembly to respond to the anticipated variation, in which the variation in the characteristic of ink drops is anticipated based on the jetting frequency of jetting of the ink drops.

2. The method of claim 1 in which the variation in the characteristic of ink drops comprises a mass of the ink drops.

3. The method of claim 1 in which the variation in the characteristic of ink drops comprises a speed of the ink drops.

4. The method of claim 1, comprising determining the jetting frequency based on a transport speed of a substrate on which the ink drops are jetted.

5. The method of claim 1, comprising determining the anticipated variation of the characteristic by comparing the characteristic to a standard.

6. The method of claim 1 in which the voltage applied on the ink jet assembly is in the form of pulses.

7. The method of claim 6, in which causing the voltage to respond to the variation comprises varying an amplitude of the pulses.

8. The method of claim 6, in which causing the voltage to respond to the variation comprises varying a width of the pulses.

9. The method of claim 6, in which the pulses have a form that comprises at least square, triangle, or trapezoidal.

10. The method of claim 1, comprising generating the voltage based on the anticipated variation.

11. The method of claim 10, comprising amplifying the voltage and applying the voltage to the ink jet assembly.

12. The method of claim 1 in which the voltage applied on the ink jet assembly ranges between about 70 V to about 150 V.

13. The method of claim 1 in which the ink drops have a size of about 1 pico-liter to about 80 pico-liter.

14. The method of claim 1 in which the ink drops have a speed of about 1 m/s to about 12 m/s.

15. The method of claim 1 in which the jetting frequency ranges from about 1 KHz to about 25 KHz.

16. An ink jet printing system comprising:

a jetting assembly;

a unit for determining an anticipated variation in a characteristic of ink drops jetted from the jetting assembly and applying a voltage to the jetting assembly based on the anticipated variation; in which the variation in the characteristic of ink drops is anticipated based on a jetting frequency of jetting of the ink drops, and a microprocessor that includes a medium that stores a pre-determined relationship between the jetting frequency and the characteristic of the ink drops.

17. The ink jet printing system of claim 16, further comprising an encoder to determine a transport speed of a substrate on which the ink drops are jetted; and a microprocessor to calculate a jetting frequency of the jetting assembly based on the transport speed.

18. The ink jet printing system of claim 16 in which the unit comprises a controller for receiving the jetting frequency.

19. The ink jet printing system of claim 18 in which the controller is connected to the microprocessor for determining the anticipated variation in the characteristic and the voltage to reduce the anticipated variation.

20. The ink jet printing system of claim 19 in which the microprocessor determines a pulse magnitude of the voltage.

21. The ink jet printing system of claim 19 in which the microprocessor determines a pulse width of the voltage.

22. The ink jet printing system of claim 16 in which the unit comprises a pulse generator for generating the voltage.

23. The ink jet printing system of claim 16 in which the jetting assembly comprises 100 to 2000 jets.

24. The ink jet printing system of claim 16, further comprising an amplifier to amplify the voltage applied to the jetting assembly.

25. The ink jet printing system of claim 16, further comprising additional jetting assemblies, each having a pre-determined relationship between a jetting frequency of the corresponding jetting assembly and characteristics of ink drops jetted from the jetting assembly.

26. A method for use in ink jetting, the method comprising:

determining a characteristic of ink drops being jetted from an ink jet assembly at a jetting frequency using a pre-determined quantitative relationship between the jetting frequency and the characteristic, reducing an anticipated variation in a characteristic of ink drops as the ink drop is jetted from the ink jet assembly, the reducing comprising causing a voltage that is applied on the ink jet assembly to respond to the anticipated variation to cause a deviation of the characteristic from the pre-determined quantitative relationship.

* * * * *